US012559930B2

(12) United States Patent
Phenis

(10) Patent No.: US 12,559,930 B2
(45) Date of Patent: Feb. 24, 2026

(54) SEWERAGE BASIN INTERNAL DROP APPARATUS AND METHOD

(71) Applicant: Andrew Ryan Dean Phenis, Winchester, IN (US)

(72) Inventor: Andrew Ryan Dean Phenis, Winchester, IN (US)

( * ) Notice: Subject to any disclaimer, the term of this patent is extended or adjusted under 35 U.S.C. 154(b) by 0 days.

(21) Appl. No.: 18/601,505

(22) Filed: Mar. 11, 2024

(65) Prior Publication Data

US 2024/0301675 A1 Sep. 12, 2024

Related U.S. Application Data

(60) Provisional application No. 63/489,632, filed on Mar. 10, 2023.

(51) Int. Cl.

| | |
|---|---|
| ***E03F 3/04*** | (2006.01) |
| ***E03F 1/00*** | (2006.01) |
| ***E03F 5/02*** | (2006.01) |

(52) U.S. Cl.

CPC ..... *E03F 3/04* (2013.01); *E03F 1/00* (2013.01); *E03F 5/021* (2013.01); *Y10T 137/6991* (2015.04)

(58) Field of Classification Search

CPC ..... E03F 3/04; E03F 5/021; Y10T 137/6991

See application file for complete search history.

(56) References Cited

U.S. PATENT DOCUMENTS

| | | | | |
|---|---|---|---|---|
| 2,935,349 | A * | 5/1960 | Burch | E02B 11/005 285/295.2 |
| 5,366,318 | A * | 11/1994 | Brancher | E03F 5/02 285/236 |
| 5,553,973 | A | 9/1996 | Duran | |
| 5,655,564 | A * | 8/1997 | Gavin | F16L 5/10 52/21 |
| 5,941,535 | A * | 8/1999 | Richard | E03F 5/02 52/220.8 |
| 6,074,130 | A | 6/2000 | Duran | |
| 6,450,505 | B1 * | 9/2002 | Gavin | E04G 15/061 277/609 |
| 9,068,338 | B2 | 6/2015 | Padgett, Jr. | |
| 9,752,600 | B2 * | 9/2017 | Hoff | E03F 1/00 |

(Continued)

FOREIGN PATENT DOCUMENTS

| | | |
|---|---|---|
| CA | 2176074 | 11/1996 |
| CA | 2269565 | 3/2000 |

OTHER PUBLICATIONS

Inside Drop Bowl | Reliner® / Duran Inc., https://www.reliner.com/products/inside-drop-bowl (5 pages), Aug. 2, 2024.

(Continued)

*Primary Examiner* — Kevin F Murphy

(74) *Attorney, Agent, or Firm* — Daniel L. Boots; Gerald W. Roberts; Dentons Bingham Greenebaum LLP

(57) ABSTRACT

An apparatus includes a sewerage drop bowl and a lid hingedly coupled to the drop bowl. The drop bowl and the lid are configured to be cooperable to house a first portion of a sewerage pipe, are configured to be cooperable to receive a sewage flow from the sewerage pipe in a first direction, and are configured to be cooperable to redirect the sewage flow to a second direction.

16 Claims, 5 Drawing Sheets

(56) References Cited

U.S. PATENT DOCUMENTS

| | | | | |
|---|---|---|---|---|
| 10,408,242 | B1 * | 9/2019 | Chamberlain | F15D 1/025 |
| 11,274,783 | B1 * | 3/2022 | Putnam | F16L 55/1152 |

OTHER PUBLICATIONS

Inside Drop System Specifications | Reliner® / Duran Inc., https://www.reliner.com/products/inside-drop-bowl/inside-drop-system-specifications (5 pages), Aug. 2, 2024.
Romtec Utilities, The Benefits of Drop Bowls and Deflector Panels, https://romtecutilities.com/the-benefits-of-drop-bowls-and-deflector-panels/ (4 pages), Aug. 2, 2024.
GU international—GU Inside Drop, http://www.gu-international.com/products/insidedrop/index.htm (1 page), Aug. 2, 2024.
IntraFlow Low Profile Inside Drop System, Water Online, https://www.wateronline.com/doc/intraflow-low-profile-inside-drop-system-0001 (1 page), Aug. 2, 2024.
PP/GRP Synthetic Material Drop Structures, https://www.predl.eu/en/products/drop-structures (9 pages), Aug. 2, 2024.
Funke-ILA, Internal Backdrop System Ortenau, Funke Kunststoffe GmbH (2 page product brochure).

* cited by examiner

SEWERAGE BASIN INTERNAL DROP APPARATUS AND METHOD

CROSS-REFERENCE TO RELATED APPLICATION(S)

The present application claims the benefit of priority of U.S. Provisional Patent Application No. 63/489,632, filed Mar. 10, 2023, entitled DUAL SEALING LATERAL SEWER LINE CONTROL DEVICE, the disclosure of which is incorporated herein by reference.

FIELD OF THE INVENTION

Various embodiments herein pertain to the field of sewerage systems and, more particularly, to internal drop devices for wastewater lift station wells and other catch basins.

BACKGROUND

Wastewater lift station wells and other sewerage catch basins have historically included internal drop systems for channeling sewage away from their inlet ports (positioned relatively high in their sidewalls) down to relatively lower sewage pooling areas. Some internal drop system designs have included an uncovered or open drop bowl attached to a lift station well sidewall and positioned directly beneath a corresponding sewage inlet port. Sewage has undesirably splashed out of such drop bowls, especially at times of high flow rates. Such splashed sewage has undesirably corroded nearby portions of lift station well sidewalls and hardware. Also, such drop bowls have allowed undesirable amounts of hydrogen sulfide ("$H_2S$") gas to be released (from incoming sewage) into upper regions of lift station wells. Such $H_2S$ gas has also undesirably corroded nearby portions of lift station well sidewalls and hardware, and has presented undesirably high respiratory hazards to maintenance workers who have entered lift station wells through manholes atop thereof.

SUMMARY OF THE INVENTION

In some embodiments, an apparatus comprises a sewerage drop bowl and a lid hingedly coupled to the drop bowl. The drop bowl and the lid are configured to be cooperable to house a first portion of a sewerage pipe, are configured to be cooperable to receive a sewage flow from the sewerage pipe in a first direction, and are configured to be cooperable to redirect the sewage flow to a second direction.

In some embodiments, an apparatus comprises a means for holding a first portion of a sewerage pipe in a sewerage basin, and a means, hingedly coupled to the means for holding, for covering a second portion of the sewerage pipe in the sewerage basin. The means for holding and the means for covering are configured to be cooperable to receive a sewage flow from the sewerage pipe in a first direction and redirect the sewage flow to a second direction.

In some embodiments, a method comprises extending a first portion of a sewerage pipe into a drop bowl in a sewerage basin, clamping a second portion of the sewerage pipe to a generally C-shaped part of the drop bowl, and hingedly pivoting a lid, relative to the drop bowl, such that the lid covers the first portion of the sewerage pipe, abuts a sidewall of the drop bowl, and extends over the generally C-shaped part of the drop bowl.

It will be appreciated that the various embodiments described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, the figures shown herein may have been created from scaled drawings, scaled models, or from photographs that are scalable. It is understood that such dimensions, or the relative scaling within a figure, are by way of example, and not to be construed as limiting unless so stated in a claim. Persons of ordinary skill will also recognize that computer-aided design ("CAD") renderings may include lines that pertain to changes in surface geometry, and not necessarily to component features.

DETAILED DESCRIPTION OF ONE OR MORE EMBODIMENTS

Figure 1:
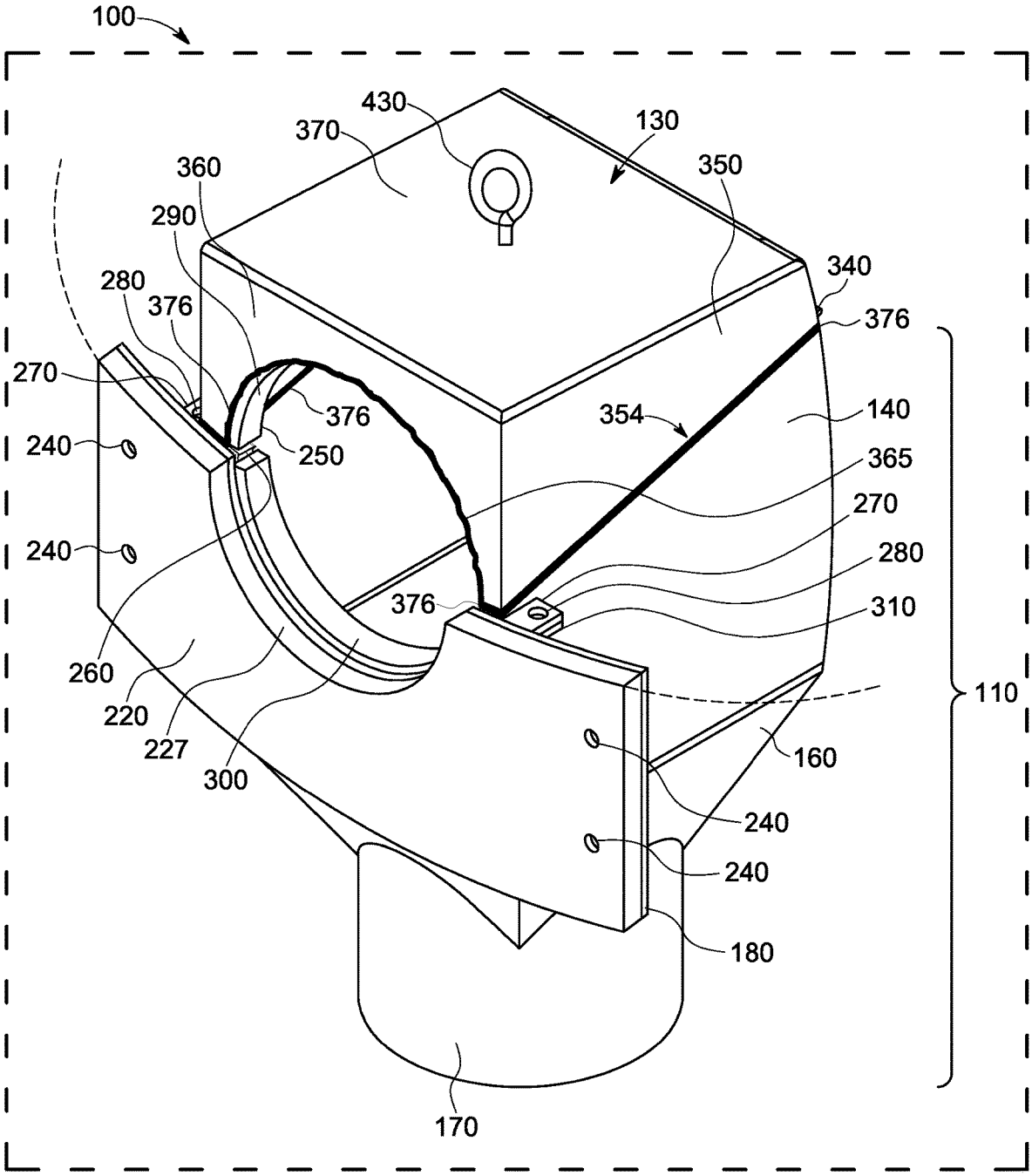
FIG. 1 is a front perspective view of a multi-sealed, clamshell-like sewerage flow diverter in accordance with aspects of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention, and further permits the reasonable and logical inference of still other embodiments as would be understood by persons of ordinary skill in the art.

It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "various embodiments" or "preferably," refers to features and aspects that are present in at least one embodiment, but which are optional for some embodiments, it therefore being understood that use of the word "preferably" implies the term "optional."

Like reference numerals refer to like parts throughout the description and the drawings. Additionally, the use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that some features 1020.1 and 20.1 may be backward compatible, such that a feature of a later discussed embodiment (NXX.XX) may include features compatible with other various embodiments that were discussed earlier (MXX.XX), as would be understood by those of ordinary skill in the art. This description convention also applies to the use of prime (′), double prime (″), triple prime (‴) and star or asterisk (*) suffixed element numbers. Therefore, it is not necessary to describe the features of 20.1, 20.1′, 20.1″, 20.1″ and 20* that are the same, since these common features are apparent to persons of ordinary skill in the related field of technology.

What follows are paragraphs that express particular embodiments of the present invention. In those paragraphs that follow, some element numbers may be prefixed with an "X" indicating that the words pertain to any of the similar features shown in the drawings or described in the text. However, those of ordinary skill in the art will recognize various other non-X prefixed element numbers that discuss features applicable to other embodiments.

This document may use different words to describe the same element number, or to refer to an element number in a specific family of features (NXX.XX). It is understood that such multiple, different words are not intended to provide a redefinition of any language herein. It is understood that such words demonstrate that the particular feature can be considered in various linguistical ways, such ways not necessarily being additive or exclusive.

FIG. 1 is a front perspective view of a multi-sealed, clamshell-like sewerage flow diverter 100 in accordance with aspects of the present disclosure. Except as otherwise expressly specified in this description or in the claims, the flow diverter 100 may be made of steel, fiberglass, carbon fiber, and/or any other suitable material(s) or any suitable combination thereof. The flow diverter 100 comprises a funnel-like conduit or drop bowl 110 and a lid 130.

The drop bowl 110 comprises a pair of opposing body sidewalls 140, a back wall 150 (the back wall 150 is not marked in FIG. 1, but see, e.g., FIGS. 2-4), a tapered portion 160, an outlet pipe 170, a mounting plate 180, a flanged, arcuate, generally C-shaped upper pipe clamp 250, and a flanged, arcuate, generally C-shaped lower pipe clamp 260. The tapered portion 160 includes an aperture 190 (not marked in FIG. 1, but see, e.g., FIG. 5). The outlet pipe 170 descends substantially vertically from the aperture 190. In some embodiments, the aperture 190 and the outlet pipe 170 have the same diameter. The body sidewalls 140 and the back wall 150 extend substantially vertically and generally upwardly from the tapered portion 160, with the back wall 150 disposed between the body sidewalls 140. In some embodiments, the back wall 150 may be curved to encourage incoming sewage flows to smoothly transition into the tapered portion 160. In such embodiments, the back wall 150 generally bulges away from the incoming sewerage pipe 410 (not marked in FIG. 1, but see, e.g., FIGS. 3 and 5) and curves downward towards the aperture 190.

Figure 2:
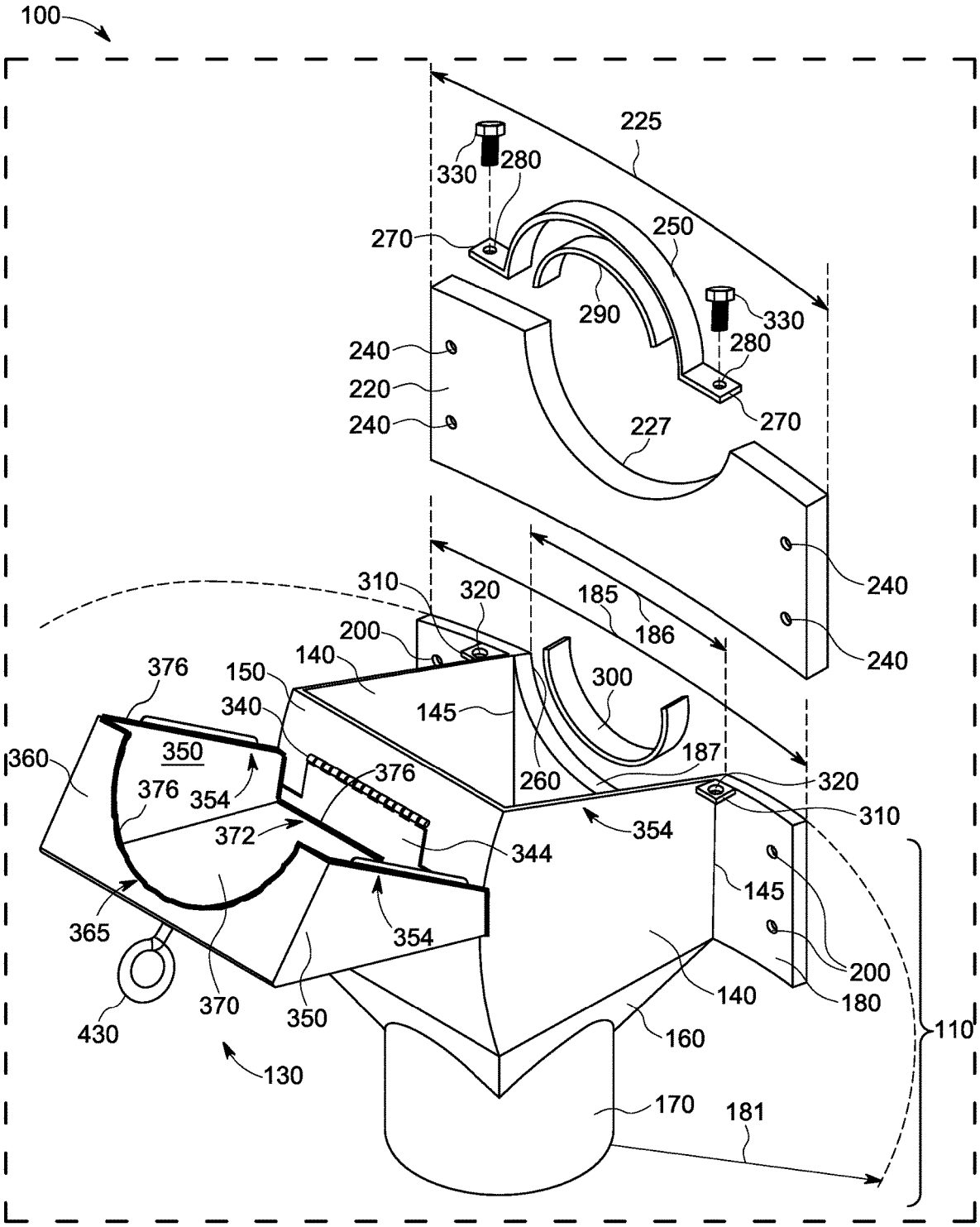
FIG. 2 is a partially exploded rear perspective view of the multi-sealed, clamshell-like sewerage flow diverter in an opened-lid state.
Figure 3:
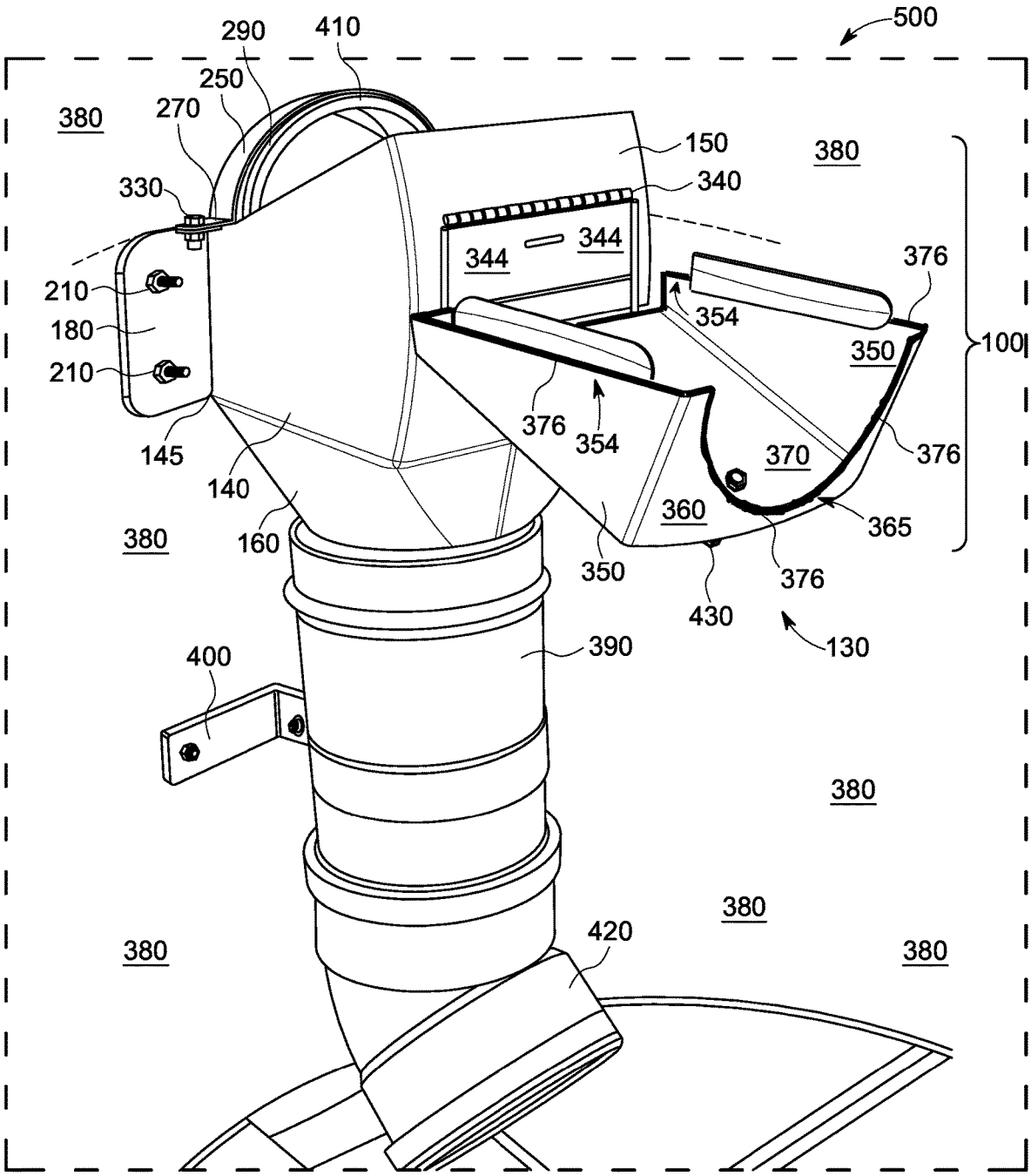
FIG. 3 is a rear perspective view of a multi-sealed sewerage basin internal drop in an opened-lid state, as installed in a sewerage basin, in accordance with aspects of the present disclosure.
Figure 4:
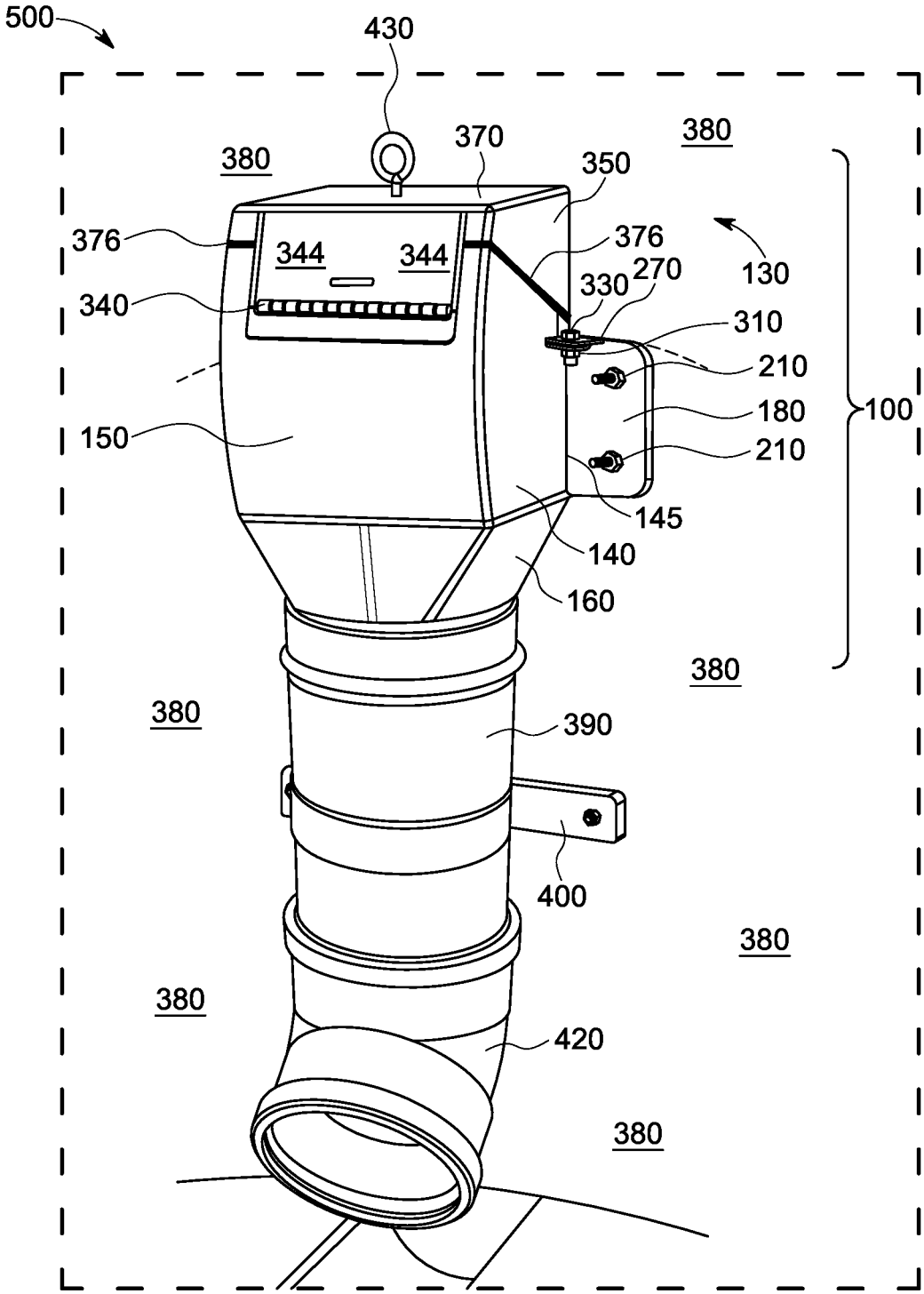
FIG. 4 is a rear perspective view of the multi-sealed sewerage internal drop in a closed-lid state, as installed in the sewerage basin.

The mounting plate 180 is welded, glued, or otherwise suitably fixedly attached to respective edge portions 145 of the body sidewalls 140 (the edge portions 145 are not marked in FIG. 1, but see, e.g., FIGS. 2-4). The mounting plate 180 has a lateral length or span 185 greater than the lateral distance or spacing 186 between the body sidewalls 140, such that the mounting plate 180 extends laterally beyond each of the body sidewalls 140 (the lateral length 185 and lateral distance 186 are not marked in FIG. 1, but see, e.g., FIG. 2). Further, the mounting plate 180 has a curved top plan profile such that the mounting plate 180 has a top plan radius of curvature 181 (not marked in FIG. 1, but see, e.g., FIG. 2) being about the same as that of an inner sidewall 380 (not marked in FIG. 1, but see, e.g., FIGS. 3-5) of a lift station well or other sewerage basin 440 (not marked in FIG. 1, but see, e.g., FIG. 5) to which the mounting plate 180 may be mounted, such that the mounting plate 180 may abut generally flush against the inner sidewall 380. In some embodiments, the mounting plate 180 may be substantially planar. A portion of the mounting plate 180 extends between the body sidewalls 140 and defines a generally C-shaped edge 187 (not marked in FIG. 1, but see, e.g., FIG. 2). The portions of the mounting plate 180 that laterally extend beyond the body sidewalls 140 each define a plurality of mounting holes 200 (not marked in FIG. 1, but see, e.g., FIG. 2).

A wall gasket 220 is attached to the mounting plate 180. The wall gasket 220 has roughly the same shape and contour as the mounting plate 180, and is configured to have or conform to a curved top plan profile such that the wall gasket 220 may have about the same radius of curvature as the mounting plate 180 and abut generally flush between the mounting plate 180 and inner sidewall 380. In some embodiments, the wall gasket 220 may be substantially planar and have about the same contour and top plan profile as substantially planar embodiments of the mounting plate 180. The wall gasket 220 has a lateral length or span 225 (not marked in FIG. 1, but see, e.g., FIG. 2) greater than the lateral distance or spacing 186 between the plurality of body sidewalls 140, such that the wall gasket 220 extends laterally beyond each of the body sidewalls 140. Also, a portion of the wall gasket 220 extends between the body sidewalls 140 and defines a generally C-shaped edge 227. Portions of the wall gasket 220 that laterally extend beyond the body sidewalls 140 each define a plurality of gasket wall holes 240. The gasket wall holes 240 align with the mounting holes 200 such that a plurality of wall anchors 210 may pass through the mounting plate 180 with attached wall gasket 220 and secure the flow diverter 100 to the inner sidewall 380 of the sewerage basin 440 (the wall anchors 210 are not marked in FIG. 1, but see, e.g., FIGS. 3 and 4). The wall gasket 220 is made of EPDM rubber or any other suitable material. When sandwiched between the mounting plate 180 and the inner sidewall 380, the wall gasket 220 creates a fluid-tight seal between the inner sidewall 380 and the mounting plate 180, which inhibits sewage from flowing along the inner sidewall 380 of the sewerage basin 440. In addition to providing a fluid-tight seal, the wall gasket 220 also serves to dampen vibrations that may be generated by force main sewage flows. Thus, it should be appreciated that the wall gasket 220 may also act as a shock absorber which prevents stress on the welds and the material of the flow diverter 100.

Upper clamp terminal flanges 270 extend substantially horizontally from each end of the upper pipe clamp 250. Each upper clamp terminal flange 270 includes an upper clamp bolt hole 280 that extends through the upper clamp terminal flange 270. The upper pipe clamp 250 is configured to be positioned above an incoming sewerage pipe 410 (not marked in FIG. 1, but see, e.g., FIGS. 3 and 5) and has an arcuate shape to accommodate the contour of the incoming sewerage pipe 410. Additionally, an upper pipe clamp gasket 290 is attached to the surface of the upper pipe clamp 250 facing the incoming sewerage pipe 410. The upper pipe clamp gasket 290 has an arcuate shape to accommodate the contour of the upper pipe clamp 250 and the incoming sewerage pipe 410. The upper pipe clamp gasket 290 is made of EPDM rubber or any other suitable material. The lower pipe clamp 260 is arranged to be positioned beneath the incoming sewerage pipe 410, has an arcuate shape to accommodate the contour of the incoming sewerage pipe 410, and is connected to the mounting plate 180. A lower pipe clamp gasket 300 is attached to the surface of the lower pipe clamp 260 facing the incoming sewerage pipe 410. The lower pipe clamp gasket 300 has an arcuate shape to accommodate the contour of the lower pipe clamp 260 and the incoming sewerage pipe 410. The lower pipe clamp gasket 300 is made of EPDM rubber or any other suitable material. The lower pipe clamp 260 also includes lower clamp terminal flanges 310 that extend substantially horizontally from and perpendicular to the body sidewalls 140. Each lower clamp terminal flange 310 includes a lower clamp bolt hole 320 that extends through the lower clamp terminal flange 310 (the lower clamp bolt holes 320 are not marked in FIG. 1, but see, e.g., FIG. 2). When the upper pipe clamp 250 is positioned above the incoming sewerage pipe 410, each lower clamp bolt hole 320 is positioned beneath each upper clamp bolt hole 280. In some embodiments, a clamp bolt 330 (not marked in FIG. 1, but see, e.g., FIGS. 2-5) may be used to secure the upper pipe clamp 250 to the lower pipe clamp 260. In some embodiments, upper pipe clamp 250 may snap onto the lower pipe clamp 260. In some embodiments, the upper pipe clamp 250 may be secured to the lower pipe clamp 260 via an interference fit. When upper pipe clamp 250 is secured around the incoming sewerage pipe 410, the upper pipe clamp gasket 290 and lower pipe clamp gasket 300 contact the incoming sewerage pipe 410 to create a fluid-tight seal around the incoming sewerage pipe 410. The fluid-tight seal prevents sewage from flowing along the inner sidewall(s) 380 of the sewerage basin 440, as allowed by prior art internal drop systems. The fluid tight seal prevents corrosive sewage from contacting the inner sidewall(s) 380 of the sewerage basin 440 and permits the application of protective coatings to the inner sidewall(s) 380 of the sewerage basin 440.

The lid 130 is attached to the back wall 150 of the drop bowl 110 via a hinge 340. The hinge 340 includes a hinge plate 344 (not marked in FIG. 1, but see, e.g., FIGS. 2-4). The lid 130 includes a pair of opposing lid sidewalls 350 (not all of which are marked in FIG. 1, but see also, e.g., FIGS. 2 and 3). The lid sidewalls 350 have respective lid sidewall edges 354 (not all marked in FIG. 1, but see also, e.g., FIGS. 2 and 3). The lid 130 also includes a front wall 360 extending between the lid sidewalls 350 and having a generally C-shaped lid front wall edge 365. Further, the lid 130 includes a top cover portion 370. The top cover portion 370 extends between the lid sidewalls 350 and extends between the front wall 360 and the hinge plate 340 such that the hinge plate 340 serves not only as a hinge plate of the hinge 340 but also as a back wall of the lid 130, and such that the top cover portion 370 and the hinge plate 340 thus form a back corner 372 (not marked in FIG. 1, but see, e.g., FIG. 2) of the lid 130. In some embodiments, the lid 130 also includes a lid gasket 376. The lid gasket 376 may be suitably configured and fitted and/or glued into the back corner 372 and onto the lid sidewall edges 354 and the lid front wall edge 365 such that when the lid 130 is in a closed-lid state corresponding portions of the lid gasket 376 are sandwiched between the back corner 372 (formed by the top cover portion 370 of the lid 130 and the hinge plate 340) and the back wall 150 (of the drop bowl 110), corresponding portions of the lid gasket 376 are sandwiched between the lid front wall edge 365 and the upper pipe clamp 250, and corresponding portions of the lid gasket 376 are sandwiched between the lid sidewall edges 354 and the body sidewalls 140 of the drop bowl 110, respectively. The lid gasket 376 may be made of EPDM rubber or any other suitable material.

Thus, when the lid 130 is in a closed position or closed-lid state, the lid 130 covers the tapered portion 160 of the drop bowl 110 (and any portion of the sewerage pipe 410 extending into the drop bowl 110). Further, when the lid 130 is in a closed-lid state portions of the lid gasket 376 (when included) are sandwiched between the back corner 372 (formed by the top cover portion 370 of the lid 130 and the hinge plate 340) and the back wall 150 (of the drop bowl 110), other portions of the lid gasket 376 (when included) are sandwiched between the lid front wall edge 365 and the upper pipe clamp 250, and yet other portions of the lid gasket 376 (when included) are sandwiched between the lid sidewall edges 354 and the body sidewalls 140 of the drop bowl 110, respectively. Also. it should be appreciated that when the lid 130 is in the closed-lid state, portions of the front wall 360 are positioned above (and, when the lid gasket 376 is omitted, may rest directly on) respective portions of the upper clamp terminal flanges 270 and/or on other respective portions of the upper pipe clamp 250. In some embodiments, the front wall 360 of the lid 130 and the upper pipe clamp 250 are configured such that when the lid 130 is in the closed-lid state portions of the lid gasket 376 (or, when the lid gasket 376 is omitted, portions of the front wall 360 alone/directly) rest freely (under gravity) on corresponding portions of the upper pipe clamp 250. In some embodiments, the front wall 360 and the upper pipe clamp 250 are configured that when the lid 130 is in the closed-lid state portions of the lid gasket 376 (or, when the lid gasket 376 is omitted, portions of the front wall 360) fit suitably snuggly but removably (by an interference fit, friction, compression, or any other suitable manner) on the upper pipe clamp 250. In some embodiments, the front wall 360 and the upper pipe clamp 250 may include cooperative opposing snap elements, such that when the lid 130 is in the closed-lid state the front wall 360 and the upper pipe clamp 250 may suitably releasably snap into engagement. It should also be appreciated, then, that in the closed-lid state the lid 130 and drop bowl 110 are cooperable to house a portion of the sewerage pipe and are cooperable to confine splashes of sewage from the tapered portion 160 of the drop bowl 110 and that, in some embodiments, when the lid 130 is in a closed-lid state the lid gasket 376 (or, when the lid gasket 376 is omitted, the front wall 360) provides an at least substantially fluid tight seal between the lid 130 and the drop bowl 110. It should also be appreciated that in the closed-lid state the lid 130 contains splashing sewage when the system experiences a high flow rate of sewage. Furthermore, it should be appreciated that in some embodiments the lid 130 may be automatically pivotally openable away from the drop bowl 110 in response to an excessive sewage pressure (i.e., to automatically open), thus providing a fail-safe in the event that the bowl 110 (or a sewage flow therefrom) becomes clogged or blocked. It should also be appreciated that the presence of the lid 130 may serve to mitigate releases of $H_2S$ and other potentially dangerous and corrosive gases into the sewerage basin 440. Instead of such gases being released directly into the sewerage basin 440, the clamshell-like housing provided by the coupling of the lid 130 to the drop bowl 110 may contain the gases and promote their conveyance to a lower region of the sewerage basin 440, where they may present less risk to a maintenance worker who enters the sewerage basin 440 from atop thereof.

When the lid 130 is in an opened position or opened-lid state, the tapered portion 160 of the drop bowl 110 (and any portion of the sewerage pipe 410 extending into the drop bowl 110) are uncovered, and sewage flowing from the sewerage pipe 410 may relatively freely splash out of the tapered portion 160. The hinge 340 permits the lid 130 to be flipped open manually (e.g., for access to the tapered portion 160 in the event that maintenance or unclogging operations need to be performed). Accordingly, the lid 130 also includes an eye bolt 430 attached to the top cover portion 370. In the event that the lid 130 has or has been opened, the eyebolt 430 allows a sanitation worker to close the lid 130 without climbing down into the sewerage basin 440. It should be appreciated that the lid 130 may be so pivoted into the closed-lid state (from outside of the sewerage basin 440) by hooking an end of an extension pole, pull chain, or other suitable closure tool (not shown) through the eye bolt 430 and pulling up on and/or otherwise further suitably manipulating the closure tool. It should also be appreciated that, conversely, the lid 130 (when closed) may then be similarly manually opened. In some embodiments, the eye bolt 430 may be replaced with a hook, a handle, and/or other feature(s) suitable for facilitating similar manipulations of the lid 130.

FIG. 2 is a partially exploded rear perspective view of the flow diverter 100 in an opened-lid state.

FIG. 3 is a rear perspective view of a multi-sealed sewerage basin internal drop 500 in an opened-lid state, as installed in a sewerage basin, in accordance with aspects of the present disclosure. The flow diverter 100 is attached to an inner sidewall 380 of a sewerage basin 440. The upper pipe clamp 250 is fitted over the incoming sewerage pipe 410 to secure the flow diverter 100 to the incoming sewerage pipe 410. In some embodiments, a substantially vertical drop pipe 390 is fitted over the outlet pipe 170 (not marked in FIG. 3, but see, e.g., FIGS. 1 and 2) of the flow diverter 100. The drop pipe 390 is secured to the inner sidewall 380 via a pipe bracket 400. A 45° elbow fitting 420 is connected to the drop pipe 390 opposite the outlet pipe 170. It should be appreciated that in operation sewage may flow or pour directly from the elbow fitting 420 into the sewerage basin 440 (under the force of gravity).

FIG. 4 is a rear perspective view of the internal drop 500 in a closed-lid state, as installed in the sewerage basin 440. The flow diverter 100 is attached to an inner sidewall 380 of the sewerage basin 440.

Figure 5:
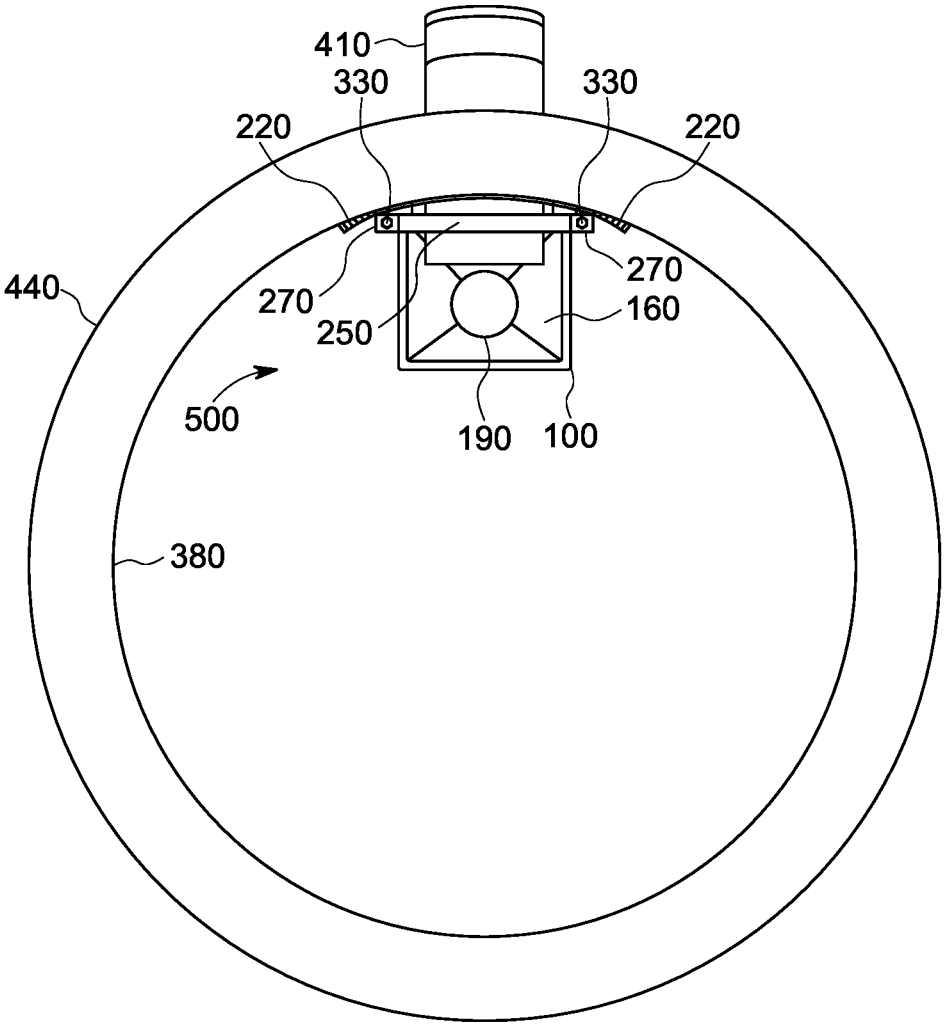
FIG. 5 is a top plan view of the multi-sealed sewerage internal drop with its lid removed, as installed in the sewerage basin.

FIG. 5 is a top plan view of the internal drop 500 with its lid 130 removed, as installed in the sewerage basin 440. It should be appreciated that the flow diverter 100 is attached to an inner sidewall 380 of the sewerage basin 440 in accordance with aspects of the present disclosure. Also, the aperture 190 is marked in FIG. 5.

To use the multi-sealed sewerage basin internal drop apparatus 500 in the sewerage basin 440, a sewerage worker or other user installs the drop bowl 110 under the generally horizontally extending incoming sewerage pipe 410. To install the drop bowl 110 under the incoming sewerage pipe 410, the user seats the lower pipe clamp gasket 300 against a bottom portion of the incoming sewerage pipe 410. The user seats the upper clamp gasket 290 on a top portion of the incoming sewerage pipe 410. Preferably, the incoming sewerage pipe 410 extends 1"-2" beyond the upper pipe clamp 250 into the drop bowl 110. Before finally securing the internal drop apparatus 500 to the extending incoming sewerage pipe 410, the user firmly presses the drop bowl 110 against the inner sidewall 380 of the sewerage basin 440. The user drills holes into the inner sidewall 380 of the sewerage basin 440 such that the drilled holes align with the mounting holes 200 in the mounting plate 180. The user secures the drop bowl 110 to the inner sidewall 380 of the sewerage basin 440 by positioning one of the wall anchors 210 through each gasket wall hole 240 and mounting hole 200 into each drilled hole. The user tightens the wall anchors 210 until the drop bowl 110 is firmly attached to the inner sidewall 380 of the sewerage basin 440. To finally secure the internal drop apparatus 500 to the extending incoming sewerage pipe 410, the user secures the upper pipe clamp 250 to the incoming sewerage pipe 410 by securing a fastener through each upper clamp terminal flange 270 and each lower clamp terminal flange 310. The user then joins the substantially vertical drop pipe 390 to the outlet pipe 170 via appropriate fittings, such as a bell, fernco, or coupler. Further, the user secures the substantially vertical drop pipe 390 to the inner sidewall 380 of the sewerage basin 440 via the pipe bracket 400 and joins the elbow 420 to the substantially vertical drop pipe 390. Then, in operation, the internal drop apparatus 500 receives a sewage flow from the sewerage pipe 410 and discharges the sewage flow (from the elbow fitting 420) into the sewerage basin 440. Further, as desired or necessary the user (preferably, but not necessarily, from outside of the sewerage basin 440) pivotally opens the lid 130 away from the drop bowl 110 and sewerage pipe 410 or, conversely, pivotally closes the lid 130 onto the drop bowl 110 and sewerage pipe 410, by hooking a tool (not shown) through the eye bolt 430 and suitably manipulating the tool.

It should be appreciated that using an internal drop apparatus according to the present disclosure may, among other things: ameliorate erosions of sidewalls and other catch basin structures and hardware by holding down their exposures to corrosive sewage flows and splashes; ameliorate maintenance workers' risks of exposure to potentially noxious sewage splashes; and/or ameliorate maintenance workers' risks of exposure to potentially hazardous levels of $H_2S$ gas by holding down releases of such gas into upper regions of lift station wells or other catch basins.

While the inventions have been illustrated and described in detail in the drawings and foregoing description, the same is to be considered as illustrative and not restrictive in character, it being understood that only certain embodiments have been shown and described and that all changes and modifications that come within the spirit of the inventions are desired to be protected.

What is claimed is:

1. An apparatus, comprising:

a sewerage drop bowl;

a lid hingedly coupled to the drop bowl;

a first pipe clamp gasket being configured to be sandwiched between a first part of the drop bowl and a second portion of a sewerage pipe;

a second pipe clamp gasket being configured to be sandwiched between a second part of the drop bowl and a third portion of the sewerage pipe; and a wall gasket being configured to be sandwiched between a third part of the drop bowl and an inner wall of a sewerage basin, wherein the drop bowl and the lid are configured to be cooperable to house a first portion of the sewerage pipe, are configured to be cooperable to receive a sewage flow from the sewerage pipe in a first direction, and are configured to be cooperable to redirect the sewage flow to a second direction.

2. The apparatus of claim 1, wherein the third part of the drop bowl includes a mounting plate configured to be mounted to the inner wall of the sewerage basin.

3. The apparatus of claim 2, wherein the drop bowl includes a sidewall attached to the mounting plate, wherein the first part of the drop bowl includes a first pipe clamp, wherein the second part of the drop bowl includes a second pipe clamp attached to the mounting plate, and wherein the first pipe clamp and the second pipe clamp are configured to be removably coupled together.

4. The apparatus of claim 1, further comprising:

an eye bolt attached to the lid.

5. The apparatus of claim 1, wherein the mounting plate has a curved plan profile.

6. The apparatus of claim 5, wherein the mounting plate includes a generally C-shaped edge.

7. The apparatus of claim 6, wherein the wall gasket includes a generally C-shaped edge.

8. The apparatus of claim 7, wherein the first pipe clamp is generally C-shaped, and wherein the second pipe clamp is generally C-shaped.

9. The apparatus of claim 8, wherein the lid includes a plurality of lid sidewalls, wherein the lid includes a front wall extending between the plurality of lid sidewalls, and wherein the front wall includes a generally C-shaped edge.

10. The apparatus of claim 9, further comprising:

the first portion of the sewerage pipe;

a sewerage basin including an inner wall; and a substantially vertical drop pipe extending from the drop bowl, wherein the drop bowl and the lid house the first portion of a sewerage pipe in the sewerage basin, and wherein the mounting plate is fastened to the inner wall of the sewerage basin.

11. The apparatus of claim 10, further comprising:

a lid gasket configured to be sandwiched between the lid and the bowl.

12. A method, comprising:

extending a first portion of a sewerage pipe into a drop bowl in a sewerage basin;

clamping a second portion of the sewerage pipe to a generally C-shaped part of the drop bowl; and hingedly pivoting a lid, relative to the drop bowl, such that the lid covers the first portion of the sewerage pipe, abuts a sidewall of the drop bowl, and extends over the generally C-shaped part of the drop bowl.

13. The method of claim 12, further comprising:

at least substantially fluid tightly sealing the second portion of the sewerage pipe against the generally C-shaped part of the drop bowl.

14. The method of claim 13, further comprising:

installing, in the sewerage basin, an internal drop including the drop bowl and the lid;

receiving a sewage flow into the internal drop from the first portion of the sewerage pipe; and discharging the sewage flow from the internal drop bowl into the sewerage basin.

15. The method of claim 14, wherein the hingedly pivoting includes hooking onto the lid with a tool and manipulating the lid from outside of the sewerage basin with the tool.

16. The method of claim 15, further comprising:

removably fastening a part of the lid to a part of the drop bowl, wherein the removably fastening includes at least one of snapping the part of the lid to the part of the drop bowl and interference fitting the part of the lid to the part of the drop bowl.

* * * * *